United States Patent [19]

Uitto et al.

[11] Patent Number: 4,671,366

[45] Date of Patent: Jun. 9, 1987

[54] METHOD FOR OPTIMIZING ROCK DRILLING

[75] Inventors: Vesa Uitto; Pasi Julkunen; Pasi Latva-Pukkila; Timo Kiikka, all of Tampere, Finland

[73] Assignee: Oy Tampella AB, Tampere, Finland

[21] Appl. No.: 736,438

[22] Filed: May 21, 1985

[30] Foreign Application Priority Data

Jun. 12, 1984 [FI] Finland ..... 842364

[51] Int. Cl.[4] ..... E21B 3/06

[52] U.S. Cl. ..... 175/27; 173/2

[58] Field of Search ..... 175/24, 26, 27; 173/2, 173/13, 14, 15

[56] References Cited

U.S. PATENT DOCUMENTS 3,464,503 9/1969 Houck ..... 173/2

3,780,814 12/1973 Herb ..... 173/2

4,109,475 8/1978 Schnell ..... 173/2

4,195,699 4/1980 Rogers et al. ..... 175/27

4,354,233 10/1982 Zhukousky et al. ..... 175/27

*Primary Examiner*—Stephen J. Novosad

*Assistant Examiner*—William P. Neuder

*Attorney, Agent, or Firm*—Ladas & Parry

[57] ABSTRACT

A method for optimizing percussive drilling, especially rock drilling, in which method the operation of the drilling device is adjusted for a desired drilling result to be obtained. According to the invention, a stress wave created in a drill rod as a result of a stroke is measured and the drilling device is adjusted on the basis of the measured stress wave. The adjusting is carried out e.g. by means of the damping rate or the spectrum of the measured stress wave or the shape of the stress wave and/or the energy fed by the different portions thereof.

11 Claims, 10 Drawing Figures

METHOD FOR OPTIMIZING ROCK DRILLING

Figure 1:
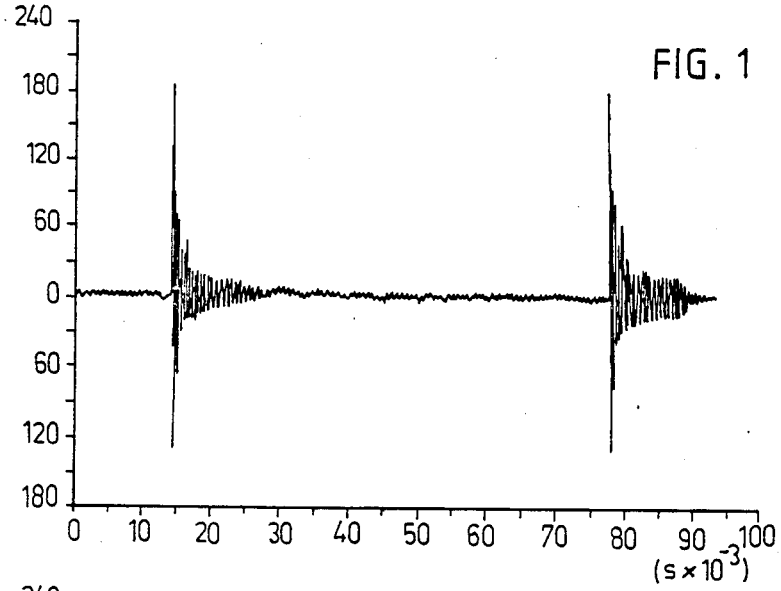

The invention relates to a method for optimizing percussive drilling, especially rock drilling, in which method the operation of the drilling device is adjusted for a desired drilling result to be obtained.

In a normal working situation, the object is to make the penetration rate of the drill as high as possible. Such restrictive factors exist as e.g. energy consumption, endurance of the devices, etc. Variables such as percussion power, rotation rate or efficiency, feeding power or a combination of different variables can be used as controlled variables.

Because of the many controlled variables, choosing the right working point of the drill is difficult. The most usual method is based on the experience of the driller and the recommendations obtained from the manufacturer of the drilling machine. In a working situation, the operation of the drilling machine can be observed by means of auditory and visual perceptions only, whereby it is possible for an experienced driller to relatively accurately choose the working point. Performing of such auditory perceptions that are of importance for the work is, however, often restricted by the noise of the surroundings. This kind of situation arises e.g. when using jumbos, i.e. drilling devices with several booms.

The working of a drilling machine is most markedly influenced by the feeding power, which, accordingly, is a variable most usually adjusted by the driller. The control of percussion and rotation is usually constant, whereby e.g. the values recommended by the manufacturer of the device or the management are applied.

An other known method comprises adjusting on the basis of the measurement of the penetration rate. The penetration rate is thereby given a maximum value by alternately adjusting the values of percussion, rotation and feed. In said method, it is also possible to be contended with the adjusting of the feed only. This kind of adjusting method is generally used only in non-percussive drilling.

The system disclosed in U.S. Pat. No. 4,165,789 can be mentioned among the individual methods known in the art. In this known system, the adjusting is solely based on the measurement of the penetration rate.

The system disclosed in U.S. Pat. No. 3,550,697 can be mentioned as an other known individual method. In this system, the adjusting is based on a torque measured from the drill, whereby the rotation rate, feeding power and torque are adjusted according to the measured torque.

A disadvantage of both said systems is, among others, their complexity, whereby their usability is not the best possible.

The object of the invention is to provide a method for optimizing rock drilling, which method avoids the weaknesses of the previously known methods. This is achieved by means of a method according to the invention, which is characterized in that a stress wave created in a drill rod as a result of a stroke is measured and that the drilling device is adjusted according to the measured stress wave.

In the description part and claims of the present application, a stress wave means the variation in the stress state created in a drill rod as a result of a stroke. According to the invention, the adjusting can be carried out on the basis of a stress wave created by one or more strokes.

An advantage of the invention is, above all, its simplicity and versatility. Be means of the method, the drilling process can be easily automatized, but, on the other hand, the method can as well be applied as an accessory in connection with manual adjusting for facilitating the work of the driller.

Figure 2:
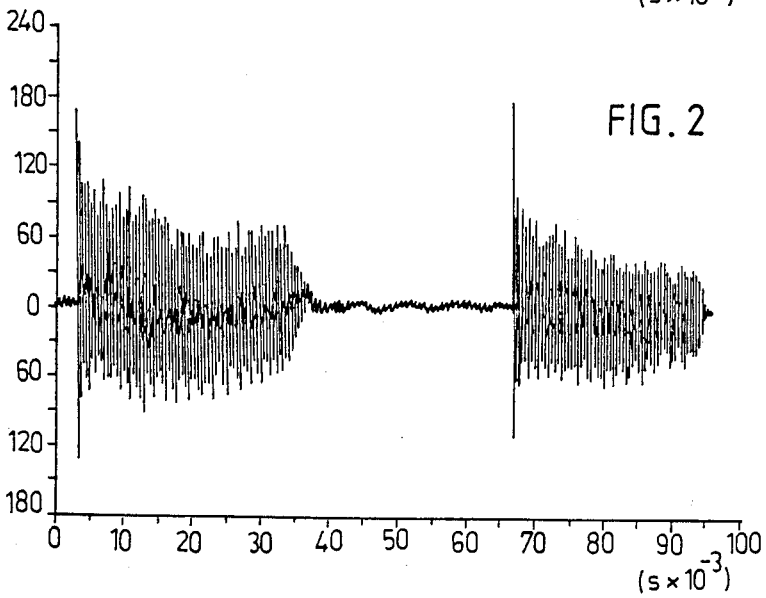
Figure 7:
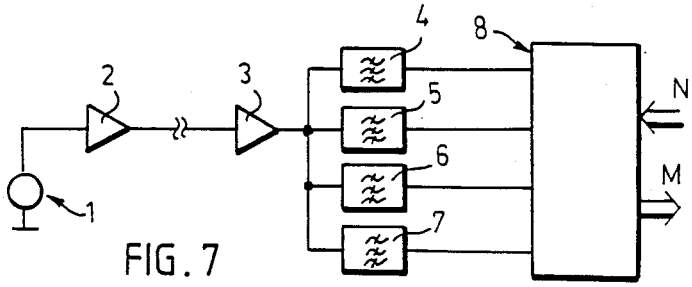
Figure 8:
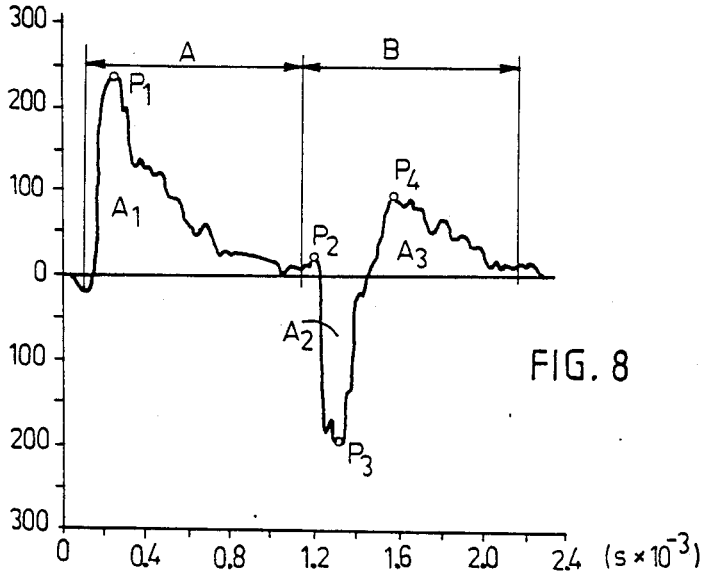
Figure 9:
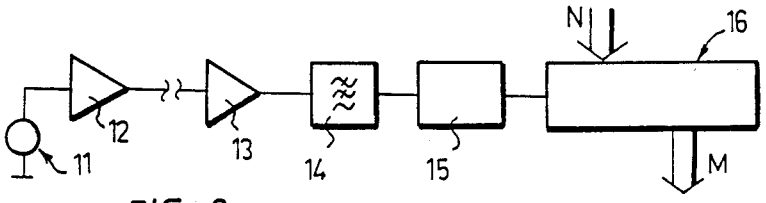
Figure 10:
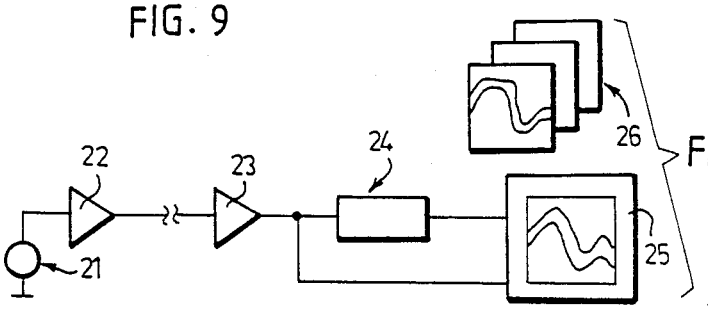

The invention will be described in the following in more detail by means of certain advantageous examples of principle, which are disclosed in the attached drawings, whereby FIGS. 1 and 2 show an example of the essentials of how a stress wave changes as a result of a change in the feeding power, FIGS. 3–6 show examples of the essentials of how the spectrum of a stress wave changes as a result of a change in the feeding power, FIG. 7 shows a block diagram of an adjusting device based on spectral analysis and applying the method according to the invention, FIG. 8 shows an example of a typical shape of the initial portion of a stress wave, FIG. 9 shows a block diagram of an automatic adjusting device based on the analysis of the shape of the stress wave, and FIG. 10 shows a block diagram of a driller's accessory based on the analysis of the shape of the stress wave.

The invention is based on one special feature of percussive drilling, i.e. that on striking the drill rod a stress impulse is always created therein, said impulse advancing along the drill rod up to the point of the rod, causing a stroke in the rock to be drilled. Part of said stress impulse is reflected backwards, because the energy content thereof cannot be fully utilized. Said stress and reflection impulses form a stress wave.

An essential feature of the invention is that said stress wave created in the drill rod is measured and the controlled variables are adjusted on the basis of the difference between the shape of the measured stress wave and/or the intensity of the different portions thereof and the normal shape or the normal values of a stress wave obtained experimentally and/or statistically. Said stress wave can be measured in several different ways, e.g. electrically, magnetically, optically or in some other such known manner. The measured stress waves can, for instance, be compared with the normal shape determined experimentally and/or statistically and the drilling device can be adjusted on the basis of the deviation of the measured wave shape from said normal shape.

According to the method of the invention the stress wave can be measured from several points on the drill rod, e.g. from two points. A measuring performed from more than one point has the advantage that the stress wave can thereby be divided into components according to the direction of movement thereof, whereby one component advances towards the rock to be drilled and the other is reflected from the rock. In this way, considerably more information is obtained on the drilling process than in a measuring performed from one point. The measuring performed from several points is especially advantageous in case the drill rod is short or the measuring point is near the end of the rod.

Adjusting of the controlled variables can be carried out by means of the intensity of either the outgoing or the reflecting wave component, the energy value determined according to the surface area of the wave, the rising or the falling rate of the impulse, the damping rate of the wave, etc. The influence of the values determined from the measured wave on the different controlled variables can be found out and the device can be adjusted by using e.g. microprocessor or some other such device, whereby the microprocessor adjusts, for instance on the basis of the values determined, the operating means of the drilling device so that the measured wave corresponds to the desired wave as accurately as possible. As the drilling conditions vary, the method according to the invention enables the operation of the drilling device to be maintained strictly in optimum almost all the time, for in principle it is possible to correct already the very following stroke after one stroke of a deviating value.

In order to illustrate the invention, three different embodiments of the method according to the invention are described in the following, whereby the adjusting can be carried out according to said embodiments.

The first embodiment is based on the utilization of the damping rate of the stress wave. As already pointed out above, each stroke directed to the drill rod causes a stress impulse in said rod, which impulse is by turns reflected from both ends of the rod, forming a gradually damping stress wave. The damping rate can be best observed by studying the envelope of the stress wave of the drill rod. The stress wave is damped at a higher rate, if the power pushing the drilling machine and the drill rod into the rock is increased. FIGS. 1 and 2 show an example of the essentials of how the envelope changes as a result of a change in the feeding power. FIG. 1 shows a situation where the feeding power is high and FIG. 2 correspondingly a situation where the feeding power is low.

The damping rate can be determined e.g. during the time period when the amplitude of the reflection impulses drops below a certain reference level or, alternatively, also as a number of reflection impulses before the amplitude drops below said reference level. The reference level can be either fixed or a certain percentage of the amplitude of the first impulse.

An other embodiment is based on the spectrum of the stress wave, as it is self-evident that if the working values of the drilling device influence the shape of the stress wave, so they naturally influence the spectrum of the stress wave, too.

Figure 3:
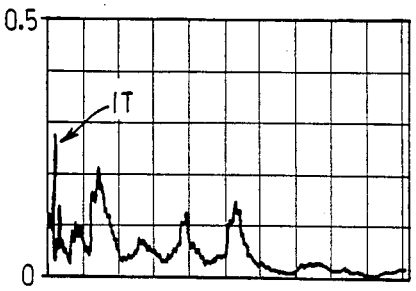
Figure 4:
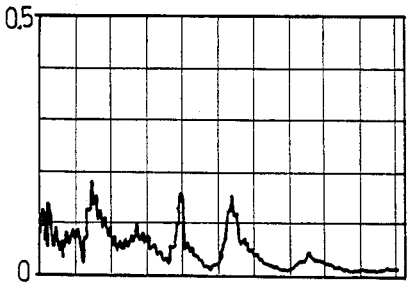
Figure 5:
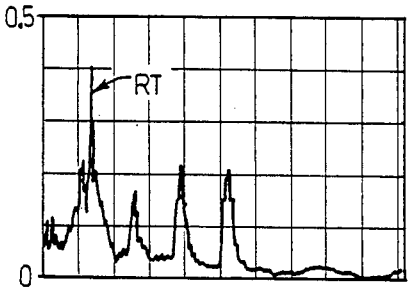
Figure 6:
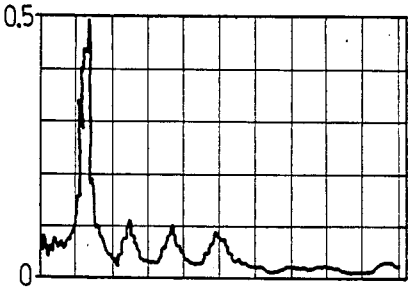

FIGS. 3–6 show in principle four different cases of the spectrum of the stress wave. In the situation of FIG. 3 a feeding pressure of 90 bars is used, in the situation of FIG. 4 a feeding pressure of 80 bars, in the situation of FIG. 5 a feeding pressure of 60 bars, and in the situation of FIG. 6 a feeding pressure of 40 bars. It appears from the figures that an overfeeding situation causes a distinctive peak to be formed in the spectrum at the percussion frequency of the machine, which point is shown in FIG. 3 by the reference IT. An underfeeding situation correspondingly brings about a peak at the resonance frequency of the drill rod, which point is shown in FIG. 5 by the reference RT. When the feeding power is appropriate, the spectrum is relatively even, as appears from the spectrum of FIG. 4.

With regard to the adjusting of the drilling device, it is not necessary to measure the spectrum in its entirety. The most interesting portions of the spectrum are the percussion frequency of the drilling machine and the resonance frequency or frequencies of the drill rod. The adjusting of the feeding power can be based on said frequency components. It is, however, self-evident that also the harmonic frequencies of the resonance frequence of the drill rod or the percussion frequency can be used additionally.

As is apparent from the Figures and the above description, there are only a few interesting frequency components, e.g. the two mentioned above. Besides, the frequencies of the interesting frequency components are previously known, so the spectrum analysis can be carried out simply by means of a number of band pass filters. FIG. 7 shows schematically a block diagram of the principal features of such an adjusting device. In the block diagram, a stress detector is indicated by the reference numeral 1, a preamplidier and an amplifier being indicated by the reference numerals 2 and 3 respectively. The band pass filters are indicated by the reference numerals 4–7, whereby the filter 4 lets through the percussion frequency and the filter 5 the resonance frequency of the drill rod. There can be more than one such filters 5, e.g. one for each desired resonance frequency. The filters 6 and 7 are intended for said harmonic frequencies and there can be several such filters, too. The adjusting logic of the device is indicated generally by means of the reference numeral 8. It is naturally also possible to feed in the device information on other measurings or on set controlled variables, such as working frequency, penetration rate, etc. This input is indicated generally by the arrow N. An output intended for the adjusting data is, in turn, indicated generally by the arrow M.

Analyzing of the shape of the stress wave created by a stroke can be presented as the third example of the application of the method. FIG. 8 shows in principle one typical shape of the initial portion of a stress wave created in the drill rod as a result of a stroke of a percussion piston. The portion A shown in the Figure thus represents an impulse or a wave component advancing towards the rock and the portion B correspondingly an impulse or a wave component proceeding away from the rock. The shape of the wave according to FIG. 8 can be interpreted either by means of the amplitude of certain points or alternatively by means of the surface areas remaining between the wave and the zero level. E.g. the maximum and minimum values $P_1$, $P_2$, $P_3$, $P_4$ can be used as characteristic points of the impulse, the amplitudes of which points can be utilized. In the adjusting, said values as such or the proportions thereof, etc., can be applied. The surface areas used in the adjusting process can consist of the surface areas of the stress wave or the different portions thereof, as for instance $A_1$, $A_2$, $A_3$, etc. It is also possible to use the proportions of said surface areas. From the data mentioned above, the energy of the stress wave in question, the energy transferred into the rock, the energy reflected from the rock, etc. can be calculated, and the adjusting can be carried out e.g. on the basis of the calculated energy values.

FIG. 9 shows a block diagram of the principal features of an automatic adjusting device, the operation of which is based on the analysis of the shape of the stress wave. In the Figure, a stress detector is indicated by the reference numeral 11, a preamplifier and an amplifier being indicated by the reference numerals 12 and 13 respectively. The reference numeral 14, in turn, indicates a so called alias filter and the reference numeral 15 an A/D transformer. A precessor which processes a signal obtained from said stress detector 11 is, in turn, indicated by the reference numeral 16. An input for measuring values obtained elsewhere is indicated by the arrow N in a manner corresponding to FIG. 7. Similarly, an output for the adjusting data is indicated by the arrow M. It is evident that there can be several measuring channels for the stress wave, though for clarity's sake only one is shown in FIG. 9.

The analysis and the interpretation of the shape of the stress wave can as well be left to the driller, if desired. If that is the case, a suitable display device naturally has to be provided. FIG. 10 shows a block diagram of the principal features of this kind of device. In the block diagram, a stress detector is shown by the reference numerals 22 and 23. The reference numeral 24 indicates a delay circuit, which may be needed for the operation of said display device 25. It is, of course, also necessary to lead a suitable synchronizing impulse to said display device 25. An essential part of said device is a magazine of subsidiary Figures, wherefrom the driller selects a reference Figure according to the requirements of any particular situation, comparing the shape of the impulse obtained from the display device with said reference Figure. By comparing these two Figures and by adjusting the controlled variables, the driller adjusts the Figure displayed on the display device so that it corresponds to the reference Figure as accurately as possible. A suitable reference Figure is selected for instance according to the drilling machine, the rock and the like. Also the present embodiment can be used when the measuring is carried out from several points, whereby it is necessary to pretreat the signals in order to obtain a suitable wave shape on the display screen. For the sake of clarity, one measuring point only is shown in FIG. 10, though there can be more, if necessary.

The above description is by no means intended to restrict the invention, but the invention can be modified within the scope of the claims in various ways. So the devices applying the method do not, of course, need to be exactly such as shown in the Figures, but other kind of solutions can be used as well. The components of the devices can be any known components, etc.

We claim:

1. A method of optimizing percussive drilling for a rock drilling operation when a drilling device in adjusted to obtain a maximum drilling capacity and a minimum load condition of a drilling equipment, the method comprising of following steps:

(a) measuring a stress wave adancing from a drill rod towards a drill bit and measuring a reflecting stress wave advancing in the drill rod away from said drill bit, said stress waves being created in said drill rod as a result of a stroke of an impact piston;

(b) comparing parameters of said measured stress waves to normative parameters of the stress waves for optimal drilling determined statistically or experimentally; and (c) adjusting percussion power, rotation power or feeding power or a combination of two or more said adjustable variables of the drilling device on the basis of said comparison of the parameters.

2. Method according to claim 1, characterized in that the drilling device is adjusted according to the damping rate of the measured stress wave.

3. Method according to claim 1, characterized in that the drilling device is adjusted according to the spectrum of the measured stress wave.

4. Method according to claim 3, characterized in that the adjusting is carried out by observing the percussion frequency point (IT) of the drilling machine and the resonance frequency point (RT) of the drill rod in the spectrum of the stress wave.

5. Method according to claim 1, characterized in that the drilling device is adjusted by means of the amplitudes of certain points ($P_1$, $P_2$, $P_3$, $P_4$) on the stress wave and/or the proportions of said amplitudes.

6. Method according to claim 1, characterized in that the drilling device is adjusted by means of the surface areas ($A_1$, $A_2$, $A_3$, $A_4$) of the different portions of the measured stress wave and/or the proportions of said surface areas.

7. Method according to claim 1, characterized in that the drilling device is adjusted by means of the energies contained in different portions of the measured stress wave and/or the proportions of said energies.

8. Method according to claim 1, characterized in that the adjusting is carried out by comparing the shape of the measured stress wave to a normative wave shape determined in advance.

9. Method according to claim 2, characterized in that the adjusting is carried out on the basis of the difference between the value of one or more variables of the measured stress wave and the set normative value of each variable.

10. Method according to claim 1, characterized in that the used controlled variable is the percussion power, rotation rate, rotation efficiency or feeding power or a combination of two or more of said variables.

11. A method according to claim 1 wherein said measuring of said stress wave and said reflecting wave is taken from at least two points on said drill rod.

* * * * *